US009816670B2

(12) United States Patent
Benson et al.

(10) Patent No.: US 9,816,670 B2
(45) Date of Patent: Nov. 14, 2017

(54) LAMP WITH FLEXIBLE CIRCUIT BOARD

(71) Applicants: Wayne Benson, Newmarket (CA); Varun Chandan, Caledon (CA)

(72) Inventors: Wayne Benson, Newmarket (CA); Varun Chandan, Caledon (CA)

(73) Assignee: Amico Clinical Solutions Corporation, Richmond Hill (CA)

( * ) Notice: Subject to any disclaimer, the term of this patent is extended or adjusted under 35 U.S.C. 154(b) by 0 days.

(21) Appl. No.: 15/013,407

(22) Filed: Feb. 2, 2016

(65) Prior Publication Data

US 2016/0223181 A1 Aug. 4, 2016

Related U.S. Application Data

(60) Provisional application No. 62/110,871, filed on Feb. 2, 2015.

(51) Int. Cl.

| | |
|---|---|
| ***F21S 4/00*** | (2016.01) |
| ***F21V 21/00*** | (2006.01) |
| ***F21K 9/00*** | (2016.01) |
| *F21W 131/20* | (2006.01) |
| *F21Y 115/10* | (2016.01) |
| *F21Y 107/50* | (2016.01) |
| *F21Y 107/70* | (2016.01) |

(52) U.S. Cl.
CPC ..... *F21K 9/00* (2013.01); *F21W 2131/20* (2013.01); *F21Y 2107/50* (2016.08); *F21Y 2107/70* (2016.08); *F21Y 2115/10* (2016.08)

(58) Field of Classification Search
USPC ..... 362/294, 249.01–249.11
See application file for complete search history.

(56) References Cited

U.S. PATENT DOCUMENTS

| | | | | |
|---|---|---|---|---|
| 8,809,820 | B2 * | 8/2014 | Dahm | B05D 3/067 250/503.1 |
| 9,341,355 | B2 * | 5/2016 | Crandell | B32B 33/00 |
| 9,357,639 | B2 * | 5/2016 | Holec | H01R 4/02 |
| 2006/0181878 | A1 * | 8/2006 | Burkholder | F21S 48/321 362/294 |

* cited by examiner

*Primary Examiner* — Daniel Hess
(74) *Attorney, Agent, or Firm* — Ridout & Maybee LLP

(57) ABSTRACT

A lamp is disclosed with a circuit board that is manufactured from a flexible material. The lamp may find particular use in a surgical or diagnostic environment. The flexible material allows the orientation of lamp elements to allow for a custom light beam. The flexible circuit board allows for interconnection between multiple lamp elements at different angles and rotation without having individual rigid circuit boards. Furthermore, the flexible circuit board may be mounted to a back panel, wherein the back panel is configured to act as a heat sink to dissipate heat generated, in operation, by the lamp element.

11 Claims, 4 Drawing Sheets

LAMP WITH FLEXIBLE CIRCUIT BOARD

CROSS-REFERENCE TO RELATED APPLICATIONS

The present application claims priority to U.S. Provisional Patent Application No. 62/110,871, filed Feb. 2, 2015, the contents of which are hereby incorporated herein by reference.

FIELD

The present application relates generally to a lamp and, more specifically, to a lamp with a flexible circuit board.

BACKGROUND

In surgical or diagnostic environments, light can play an important role. Accordingly, the ability for a surgical team to properly position a lamp for beneficial direction of light emanating from the lamp may be seen as important.

BRIEF DESCRIPTION OF THE DRAWINGS

Reference will now be made, by way of example, to the accompanying drawings which show example implementations; and in which.

DETAILED DESCRIPTION

A lamp is disclosed with a circuit board that is manufactured from a flexible material. The lamp may find particular use in a surgical or diagnostic environment. The flexible material allows the orientation of lamp elements to allow for a custom light beam. The flexible circuit board allows for interconnection between multiple lamp elements at different angles and rotation without having individual rigid circuit boards.

According to an aspect of the present disclosure, there is provided a lamp element assembly. The lamp element assembly includes a back panel defining a first plane, a flexible circuit board mounted to a first side of the back panel, a slot in the flexible circuit board defining a tab integral with the circuit board and configured to be positioned in a second plane, the second plane being distinct from the first plane and a light source mounted to the tab, wherein the back panel is configured to act as a heat sink to dissipate heat generated, in operation, by the light source.

Other aspects and features of the present disclosure will become apparent to those of ordinary skill in the art upon review of the following description of specific implementations of the disclosure in conjunction with the accompanying figures.

Figure 1:
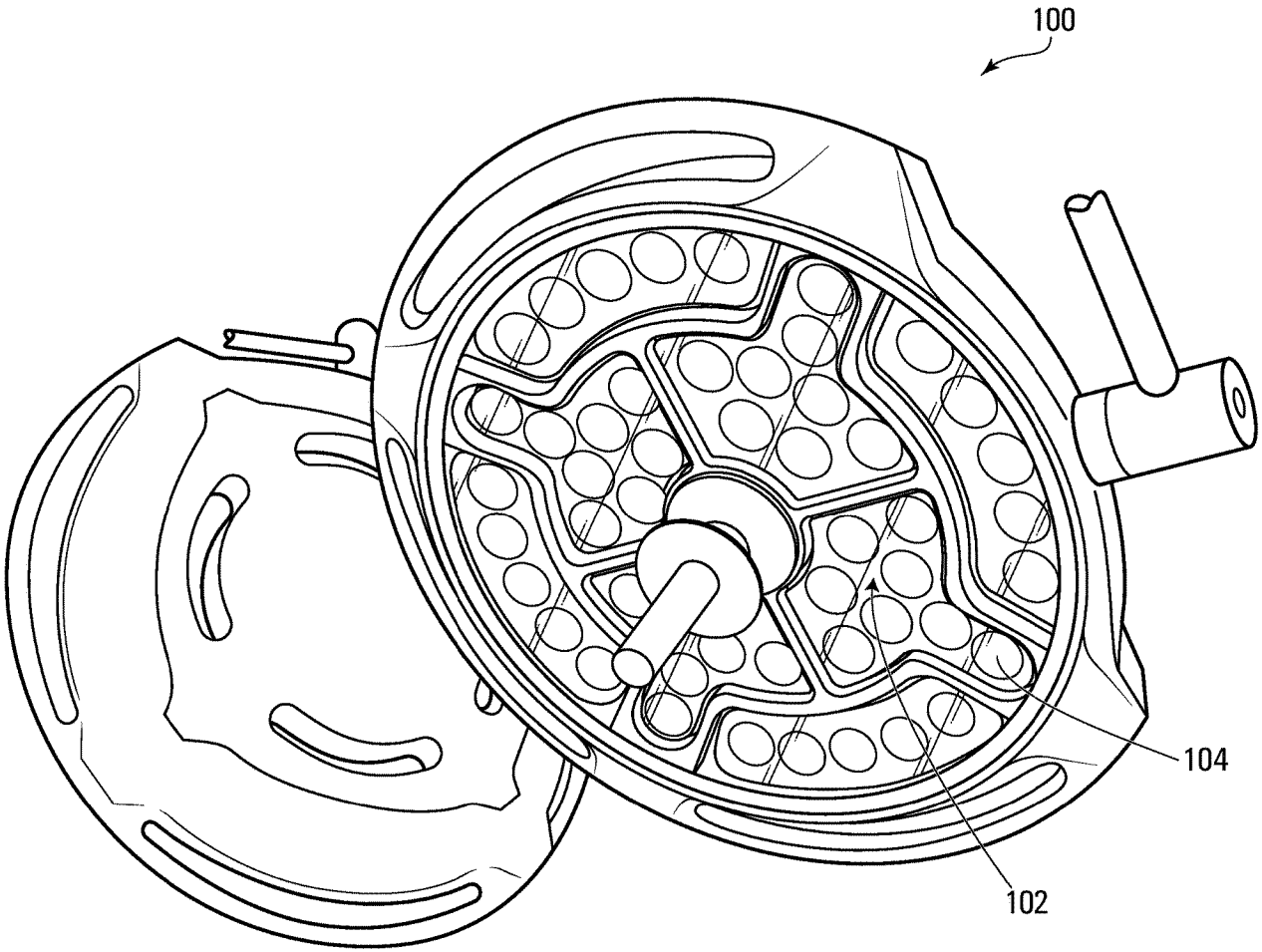
FIG. 1 illustrates a lamp having a plurality of lamp element assemblies, each lamp element assembly having a plurality of lamp elements, in accordance with an embodiment of the present application.

FIG. 1 illustrates a lamp 100 having a plurality of lamp element assemblies 102. Mounted on each lamp element assembly 102 of the plurality of lamp element assemblies 102 is a plurality of lamp elements 104. A circuit board manufactured from a flexible material may be included, as a component of the lamp element assembly 102. Accordingly, the orientation of individual lamp elements 104 mounted to distinct tabs of the circuit board may be adjusted, thereby allowing for the lamp 100 to cast a customized light beam. Notably, a lamp element 104 may include a light source and a focusing optic. One flexible material suitable for use in the circuit board is Kapton® polyimide film marketed by DuPont™ of Wilmington, Del.

Figure 2:
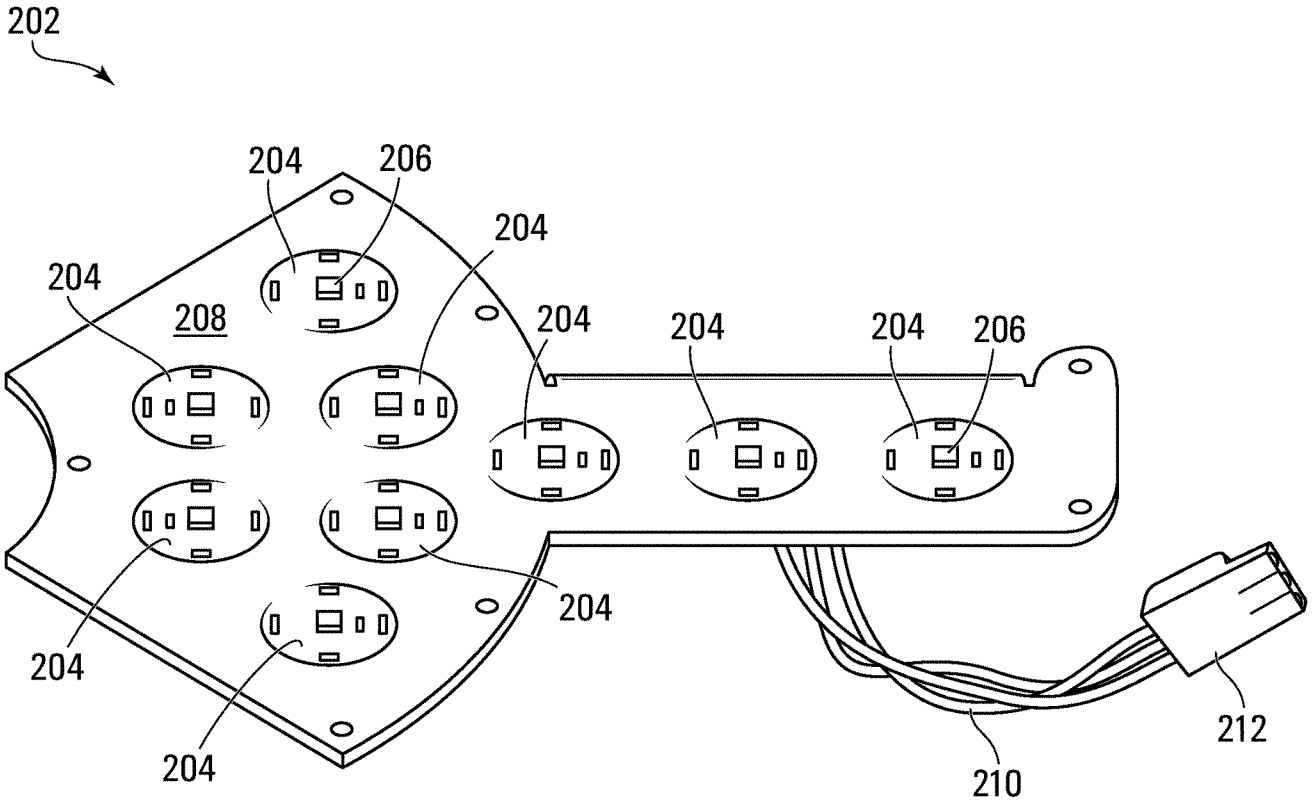
FIG. 2 illustrates an example lamp element assemblies suitable for the lamp of FIG. 1, in accordance with an embodiment of the present application.

FIG. 2 illustrates, in a top, perspective view, a lamp element assembly 202. The lamp element assembly 202 may be considered suitable for use as one of the lamp element assemblies 102 for the lamp 100 of FIG. 1. The lamp element assembly 202 illustrated in FIG. 2 includes a circuit board 208. The circuit board 208 illustrated in FIG. 2 includes a plurality of tabs 204. Each tab 204 may be, for example, defined by a C-shaped slot formed in the circuit board 208. Conveniently, the tab 204 is integral with the circuit board 208 and the C-shaped slot leaves a portion of the tab 204 attached to the circuit board 204. The portion of the tab 204 attached to the circuit board 204 can act as a hinge. It will be appreciated that the tabs 204 may be formed using slot of other shapes.

Mounted to each tab 204 is at least one light source 206. The at least one light source 206 may, for example, be a light emitting diode (LED). The lamp element assembly 202 illustrated in FIG. 2 further includes a quick connect connector 212 for connecting the lamp element assembly 202 to a connection point. The connection point may provide electrical power. Additionally, the connection point may provide control (off/on/dim) for the light sources 206. The lamp element assembly 202 illustrated in FIG. 2 further includes a cable 210 for transferring the electrical power and control signals from the connection point to the lamp element assembly 202.

Figure 3:
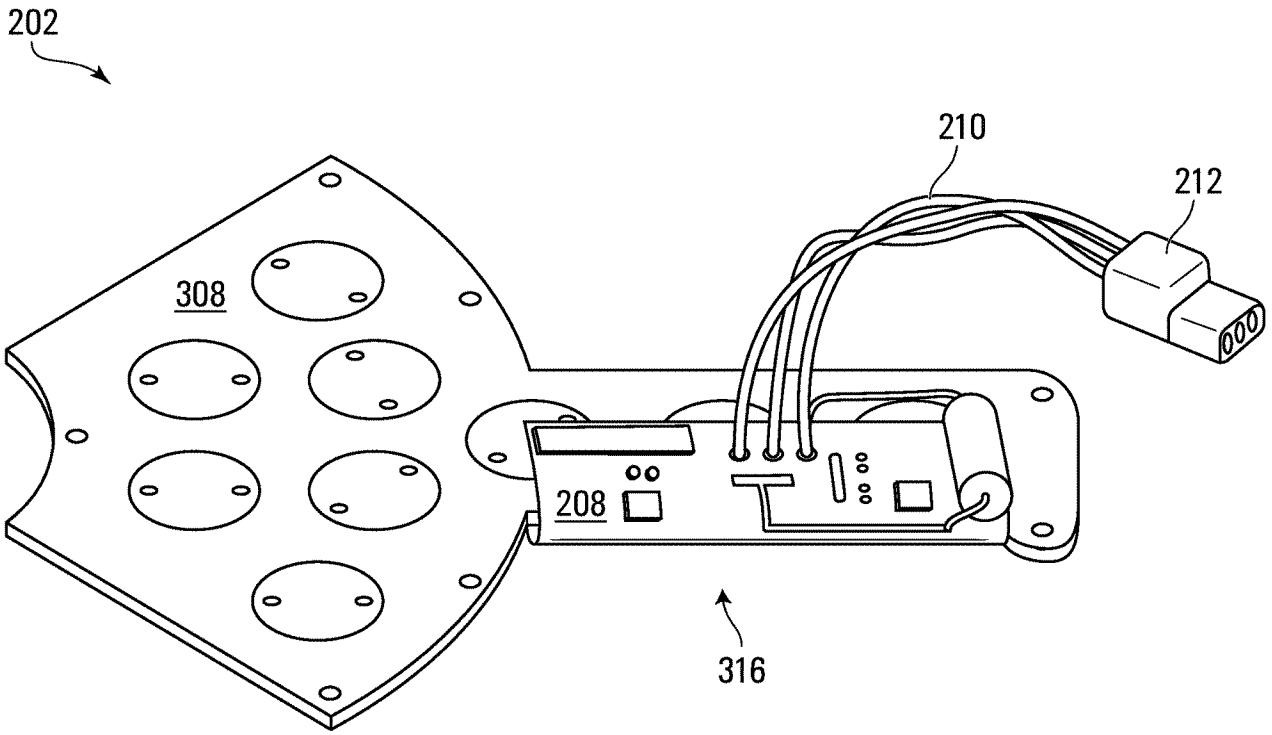
FIG. 3 illustrates, in a bottom, perspective view, the lamp element assembly of FIG. 2, in accordance with an embodiment of the present application.

FIG. 3 illustrates, in a bottom, perspective view, the lamp element assembly 202 of FIG. 2. As illustrated in FIG. 3, the lamp element assembly 202 has a rigid back panel 308. The back panel 308 may be manufactured, for example, from metal. Suitable metals to use for manufacturing the back panel 308 include aluminum, steel, copper, brass and zinc. Furthermore, the back panel 308 may be seen to define a plane.

Also illustrated in FIG. 3 is driving circuitry 316 through which electrical power may be distributed to the light sources 206. The element 210 terminates at the driving circuitry 316. Notably, the driving circuitry 316 is mounted to a portion of the circuit board 208. Conveniently, since the circuit board 208 is flexible, the portion of the circuit board 208 on which the driving circuitry 316 is mounted, may be folded around to rest against the back panel 308 on the bottom of the lamp element assembly 202.

Figure 4:
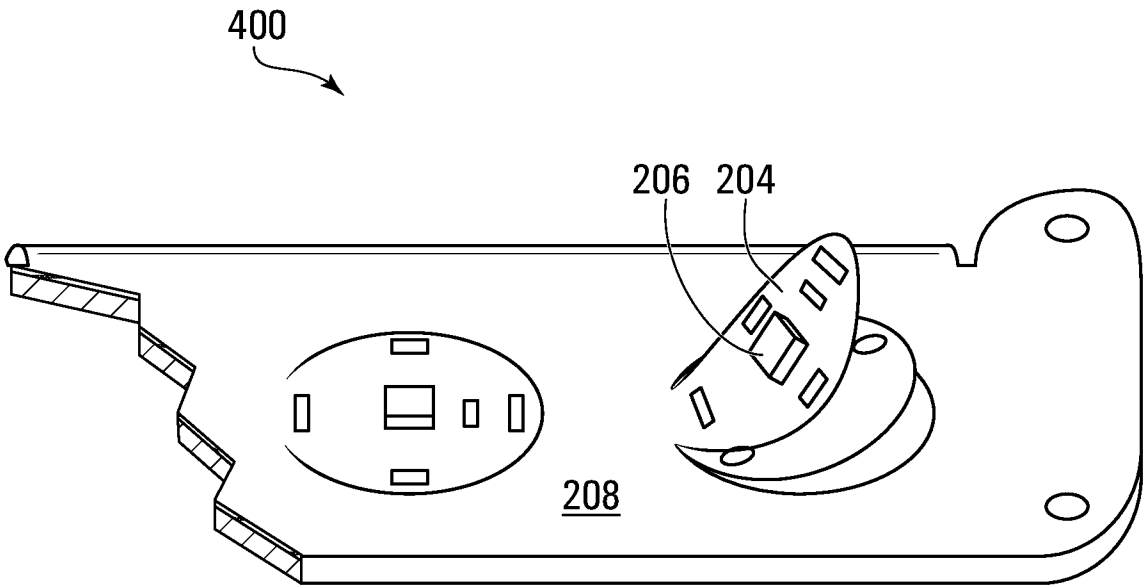
FIG. 4 illustrates, in a top, perspective view, a portion of the lamp element assembly of FIG. 2.

FIG. 4 illustrates, in a top, perspective view, a portion 400 of the lamp element assembly 202 of FIG. 2. In particular, the portion 400 is illustrated in FIGS. 4 with a tab 204 of the circuit board 208 arranged in a position and configured to be positioned in a second plane, the second plane being distinct from the plane defined by the back panel 308.

In operation, electrical power may flow from the connection point, through the quick connect connector 212, through the cable 210 and arrive at the driving circuitry 316. According to control signals, also received from the connection point via the quick connect connector 212 and the cable 210, the received electrical power may be distributed, by the driver circuitry 316, to the light sources 206.

Although not shown, a lamp element 104 (FIG. 1) may include a focusing optic (not shown) mounted to the tab 204 of the circuit board 208 that includes a light source 206. Accordingly, although the flexion of the circuit board 208 is illustrated as allowing positioning of the tab 204, in use, a user of the lamp 100 may adjust the lamp element 104 through manual manipulation of the focusing optic that is mounted to the tab 204.

It will be appreciated that the flexibility of the circuit board 208 allows for the production of a lamp element assembly 202 that interconnects multiple LEDs, with the LEDs positioned at different angles and rotation. Conveniently, the positioning of the distinct LEDs may be accomplished even in the absence of multiple individual rigid circuit boards.

Conveniently, the back panel 308 may be configured to act as a heat sink to dissipate heat generated, in operation, by the light sources 206.

The heat dissipation properties of the flexible circuit board 208 in combination with the back panel 308, on which the flexible circuit board 208 is mounted, provides for an environment in which the LEDs are likely to run cool. It may be shown that LEDs running cool can act to maximize service life for the LEDs. In general, any element acting as a light source may also be seen to generate heat. Certainly, LEDs are known to generate heat to a lesser degree than comparable incandescent light sources. However, heat generation does still occur in LED light sources.

As has been illustrated in FIG. 3, the flexible circuit board 208 allows for the folding of the portion of the circuit board 208 on which the driving circuitry 316 is mounted around the back panel 308. Such folding may be seen to provide for a clean overall design for the lamp 100. By keeping the drive circuitry 316 connected to the tabs 204 on which the light sources 206 are mounted, it may be shown that connecting wires are fewer, thereby facilitating assembly of the lamp 100 from the various components.

The above-described implementations of the present application are intended to be examples only. Alterations, modifications and variations may be effected to the particular implementations by those skilled in the art without departing from the scope of the application, which is defined by the claims appended hereto.

What is claimed is:

1. A lamp element assembly comprising:

a back panel defining a first plane;

a flexible circuit board mounted to a first side of the back panel, a slot in the flexible circuit board defining a tab integral with the circuit board and configured to be positioned in a second plane, the second plane being distinct from the first plane; and a light source mounted to the tab;

wherein the back panel is configured to act as a heat sink to dissipate heat generated, in operation, by the light source.

2. The lamp element assembly of claim 1 wherein the back panel comprises a metal.

3. The lamp element assembly of claim 2 wherein the metal comprises aluminum.

4. The lamp element assembly of claim 2 wherein the metal comprises steel.

5. The lamp element assembly of claim 2 wherein the metal comprises copper.

6. The lamp element assembly of claim 2 wherein the metal comprises brass.

7. The lamp element assembly of claim 2 wherein the metal comprises zinc.

8. The lamp element assembly of claim 1 wherein the light source comprises an light emitting diode.

9. The lamp element assembly of claim 1 further comprising driver circuitry, wherein some of the driver circuitry is mounted to the portion of the circuit board that extends beyond the back panel.

10. A lamp comprising a plurality of lamp element assemblies as defined in claim 1.

11. A lamp element assembly comprising:

a back panel defining a first plane;

a flexible circuit board mounted to a first side of the back panel, a slot in the flexible circuit board defining a tab integral with the flexible circuit board and configured to be positioned in a second plane, the second plane being distinct from the first plane; and a light source mounted to the tab;

wherein the back panel is configured to act as a heat sink to dissipate heat generated, in operation, by the light source; and wherein a portion of the circuit board extends beyond the back panel such that the portion of the circuit board may be folded around to rest against a second side of the back panel.

* * * * *